US008721307B2

(12) United States Patent
Li

(10) Patent No.: US 8,721,307 B2
(45) Date of Patent: May 13, 2014

(54) DEVICE FOR BLOWING AIR BY MEANS OF NARROW SLIT NOZZLE ASSEMBLY

(71) Applicant: Dyson Technology Limited, Wiltshire (GB)

(72) Inventor: Dezheng Li, Shaoguan (CN)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 13/686,480

(22) Filed: Nov. 27, 2012

(65) Prior Publication Data

US 2013/0330215 A1 Dec. 12, 2013

Related U.S. Application Data

(63) Continuation of application No. PCT/CN2011/074668, filed on May 25, 2011.

(51) Int. Cl.

| | |
|---|---|
| ***F04D 13/06*** | (2006.01) |
| ***F04D 29/46*** | (2006.01) |
| ***F04D 25/08*** | (2006.01) |
| ***F04D 25/10*** | (2006.01) |
| ***B05B 9/01*** | (2006.01) |

(52) U.S. Cl.

CPC ..... *F04D 25/08* (2013.01); *F04D 25/10* (2013.01); *B05B 9/01* (2013.01)

USPC ..... 417/423.14; 239/565

(58) Field of Classification Search

CPC ..... B05B 9/01; F04D 25/10; F04D 25/12; F04D 25/08

USPC ..... 417/76, 84, 155, 177, 179, 197, 198, 417/423.14; 416/9, 13, 16, 117, 118, 119; 415/51, 119, 126, 127; 239/128, 135, 239/265.17, 434.5, 561, 568, DIG. 7, 565

See application file for complete search history.

(56) References Cited

U.S. PATENT DOCUMENTS

| | | | | |
|---|---|---|---|---|
| 2,488,467 | A * | 11/1949 | De Lisio | 239/561 |
| 5,881,685 | A * | 3/1999 | Foss et al. | 123/41.49 |
| 7,198,473 | B2 * | 4/2007 | Stickland et al. | 417/362 |
| 8,529,226 | B2 * | 9/2013 | Li | 417/423.14 |
| 2006/0172682 | A1 * | 8/2006 | Orr et al. | 454/152 |
| 2009/0060710 | A1 * | 3/2009 | Gammack et al. | 415/90 |
| 2009/0078120 | A1 * | 3/2009 | Kummer et al. | 96/222 |

FOREIGN PATENT DOCUMENTS

| | | |
|---|---|---|
| CN | 101825096 | 9/2010 |
| CN | 101825101 | 9/2010 |
| CN | 101825102 | 9/2010 |

(Continued)

OTHER PUBLICATIONS

International Search Report mailed Sep. 8, 2011, directed towards International Application No. PCT/CN2011/074668; 12 pages.

*Primary Examiner* — Bryan Lettman

(74) *Attorney, Agent, or Firm* — Morrison & Foerster LLP

(57) ABSTRACT

A device for blowing air by a nozzle assembly includes a base seat for generating an air stream to supply air flow and a nozzle assembly supported by the base seat and comprising a slot-shaped opening for blowing air. An airflow passage is connected between the base seat and the nozzle assembly. An intake end of the airflow passage is opened on the outer surface of the base seat, and an output end is connected to the nozzle assembly by a pivot component. An intake end of the nozzle assembly is connected to an output end of the base seat by the pivot component. An impeller and electric motor for driving the impeller to rotate are provided within the base seat. The nozzle assembly is rotatably fixed on the base seat by the pivot component.

25 Claims, 12 Drawing Sheets

(56) References Cited

FOREIGN PATENT DOCUMENTS

| | | | | | |
|---|---|---|---|---|---|
| CN | 101825103 | | 9/2010 | | |
| CN | 101984299 | | 3/2011 | | |
| CN | 201771875 | | 3/2011 | | |
| CN | 201786777 | | 4/2011 | | |
| CN | 201858204 | | 6/2011 | | |
| CN | 201874898 | | 6/2011 | | |
| EP | 2 578 889 | A1 | 4/2013 | | |
| JP | 56-167897 | | 12/1981 | | |
| JP | S64-21300 | * | 2/1992 | ..... | F04F 5/16 |

* cited by examiner

DEVICE FOR BLOWING AIR BY MEANS OF NARROW SLIT NOZZLE ASSEMBLY

REFERENCE TO RELATED APPLICATIONS

This application is a continuation of International Application No. PCT/CN2011/074668, filed May 25, 2011, which claims the priority of Chinese Application No. 201020205107.7, filed May 27, 2010, Chinese Application No. 201020224739.8, filed Jun. 12, 2010, Chinese Application No. 201020519265.X, filed Sep. 7, 2010, and Chinese Application No. 201020536812.5, filed Sep. 20, 2010, the entire contents of which are incorporated herein by reference.

FIELD OF THE INVENTION

The present invention relates to a pumping device or system for pumping an elastic fluid by a rotary pump, in particular to a ventilation device or system in which the working fluid is air, and more particularly to a device for blowing air by means of a slot-shaped nozzle where the jetting direction of the device can be adjusted in a large range.

BACKGROUND OF THE INVENTION

A home fan usually includes a rotary shaft, a set of blades or an impeller rotating around the shaft, and driving equipment that drives the blades or the impeller to rotate for generating an air stream. The flow and circulation of air produces wind, and heat may be dissipated by air convection to make the user feel cool. The conventional home fan has the disadvantages that the air stream generated by the rotating blades or impeller cannot be uniformly sensed by the user, so the user has a feeling of "patting" generated by the turbulent airflow. Moreover, the blades occupy a large area and thus lower the room brightness.

A bladeless fan, precisely referred to as "a device for blowing air", includes a base for generating an air stream and a ring nozzle supported by the base. The ring nozzle defines an opening, and the nozzle includes an inner passage and a mouth for jetting the air stream. The base includes an air intake arranged on the housing of the base and an impeller inside the base. A discharge portion of the impeller and the inner passage of the nozzle are respectively in communication with a pipe in the base. The impeller extracts air through the air intake. The air flows through the pipe in the base and the inner passage of the nozzle, and then an air stream is jetted from the mouth of the nozzle. The patent documents U.S. Pat. No. 2,488,467, CN 101825104, CN 101858355, and CN 101825101 also disclose other fans or circulators which are similar to the above. However, the pitch of the fan or circulator can only be adjusted at a small angle, which fails to satisfy the requirement for adjusting the direction of air stream at a large angle.

In addition, there are a large amount of dust particles suspended in the air, and dusts are known as the "killer" of household appliances because the presence thereof greatly influences the performance of the household appliances. The granular material suspended in the air is composed of solid or liquid micro-particles. The particles suspended in the air include a polydisperse aerosol of solid particles and liquid particles. The conventional bladeless fan is not provided with an air filter device at the air intake, so after a long time of use, the dusts in the air adhere to the impeller, pipes in the base, inner passage, and mouth of the nozzle. Particularly, the structure inside the bladeless fan is complicated due to the structure of the impeller and is hard to disassemble for cleaning. In the absence of the air filter device, an excessive amount of dust will adhere, which adds to the load on the electric motor for driving the impeller and in turn shortens the operational lifespan and increases the energy consumption. Meanwhile, the excessive dust may block the slit of the nozzle so that the nozzle cannot jet the air stream, which in turn shortens the operational lifespan of the fan. Also, hazardous organic substances like formaldehyde, methylamine, benzene, xylene and other pollutants like the radioactive dust Iodine 131, odour and bacteria etc. exist in the air, but the conventional bladeless fan does not have deodorization and air purification functions.

In view of the above, the conventional bladeless fan has obvious inconvenience and defects in use and needs to be improved and perfected.

SUMMARY OF THE INVENTION

A technical problem to be solved by this invention is to provide a foldable device for blowing air provided with a slot-shaped nozzle, which can adjust the direction of air stream by simple operations and can be folded when it is idle so as to save the space occupied.

To solve the above technical problem in the prior art, a technical solution of this invention is a device for blowing air by means of a nozzle assembly. The device includes a base seat for generating an air stream to supply air flow and a nozzle assembly supported by the base seat, the nozzle assembly comprising a slot-shaped nozzle for blowing air. An airflow passage is connected between the base seat and the nozzle assembly. An intake end of the airflow passage is opened on the outer surface of the base seat, and an output end is connected to the nozzle assembly by means of a pivot component. An intake end of the nozzle assembly is connected to an output end of the base seat by means of the pivot component. An impeller and an electric motor for driving the impeller to rotate are provided within the base seat. The nozzle assembly is rotatably fixed on the base seat by means of the pivot component.

Preferably, the nozzle assembly is rotatably fixed on the base seat by means of the pivot component at any orientation.

Preferably, the nozzle assembly is rotatably fixed on the base seat by means of the pivot component at an elevation angle of 0-360°.

An air filter assembly may be disposed at the opening of the intake end of the airflow passage on the surface of the base seat.

Alternatively, the impeller and the electric motor may be coaxially accommodated in a casing within the base seat to constitute an air supply assembly for generating an air stream, and an air filter assembly may be installed at the opening of the intake end of the airflow passage on the casing.

The air filter assembly may be detachably installed at the opening of the intake end of each airflow passage.

As another alternative, an air filter assembly may be arranged between the opening of the intake end of the airflow passage on the surface of the base seat and the casing of the air supply assembly.

The air filter assembly may be a mesh filter, a filter laminate, or a filter cartridge based on the filter laminate.

Preferably, an accelerating transmission mechanism is installed on an output shaft of the electric motor for driving the impeller to rotate in the base seat and includes a pulley drive and a gear pair transmission mechanism.

Preferably, the nozzle assembly is overall shaped like a round or oval ring with a constant section and includes a rectifier ring for receiving the air stream in an inner cavity of the assembly, the slot-shaped nozzle for blowing air being arranged on an outer ring circumference or an oval circumference.

Preferably, the rectifier ring includes a gradually narrowing tapered area and the slot-shaped nozzle for blowing air is located at a tip of the tapered area.

Preferably, a distance between two opposing surfaces for limiting a width of the slot-shaped nozzle for blowing air is 0.2-15.0 mm, an angle formed between an air blowing direction of an air supply part of the nozzle and a central axis of the rectifier ring is 0.2-20.0°, and the length of the air supply part in the air blowing direction is 0.2-30.0 mm.

Preferably, the two opposing surfaces for limiting the width of the slot-shaped nozzle for blowing air are separated by at least one partition board extending along the nozzle, and the partition board is connected to the two opposing surfaces by a fixing member to form multiple rows of air supply outlets extending along the nozzle. Two adjacent rows of air supply outlets are arranged in alignment or in a staggered manner. Each air supply outlet includes opposing surfaces for limiting each air supply outlet, the sum of the distances between each pair of opposing surfaces is 0.2 mm-15 mm, the angle formed between the air blowing direction of the air supply part of the nozzle and the central axis of the rectifier ring is 0.2-20.0°, and the length of the air supply part in the air blowing direction is 0.2-30.0 mm.

Preferably, the pivot component includes a T-shaped hollow pipe installed within the base seat, and two ends of a horizontal pipe of the T-shaped hollow pipe are in communication with the intake end of the nozzle assembly. A vertical pipe of the T-shaped hollow pipe is in communication with the output end of the base seat. The two ends of the horizontal pipe are respectively socketed with a flange that rotates around the horizontal pipe, the flange and the nozzle assembly are fixed together, so that the nozzle assembly and the flange simultaneously rotate around the horizontal pipe.

Preferably, the pivot component includes a hollow pipe arranged at the intake end of the nozzle assembly. The hollow pipe and the nozzle assembly are fixed together, and a sealing member is arranged between the hollow pipe and an air outlet of the casing within the base seat, so that the nozzle assembly and the hollow pipe rotate together.

Preferably, a sealing member is arranged between the flange or the hollow pipe and the casing within the base seat.

Preferably, a circlip is arranged on the flange or the hollow pipe to prevent the nozzle assembly from disengaging from the casing within the base seat.

Preferably, the pivot component is connected with an assembly that facilitates smooth rotation of the nozzle assembly, and the assembly includes springs fixed in the casing of the base seat and roller balls placed on the springs. A rounded toothed connecting section is arranged on the outer circumference of each flange, and each roller ball rests against a concave portion of a respective toothed connecting section, thereby facilitating smooth rotation of the nozzle assembly around the horizontal pipe.

Alternatively, the pivot component may be connected with a plastic part that facilitates smooth rotation of the nozzle assembly, protrusions being arranged at the plastic part corresponding to the rounded toothed connecting section of the flange, and the protrusions resting against each concave portion of the toothed connecting section, thereby facilitating smooth rotation of the nozzle assembly around the horizontal pipe.

Preferably, a sealing member is arranged between the flange and the horizontal pipe, and a fastener is connected between the flange and the nozzle assembly.

Preferably, a secondary electric motor for controlling pitch rotation of the nozzle assembly and at least one drive wheel connected to the output shaft of the secondary electric motor are provided in the casing within the base seat, and the drive wheel when engaged with the pivot component makes the nozzle assembly rotate smoothly.

Preferably, the electric motor and the impeller constitute the air supply assembly of the device for blowing air, the air supply assembly is accommodated in a casing, and the casing is fixed within the base seat by a damping mechanism.

Preferably, the impeller and the electric motor are both accommodated in a casing to constitute an air supply assembly, and a shock-absorption connecting member is arranged between the casing and the intake end of the airflow passage.

Preferably, the device for blowing air further includes a swing motor disposed within the base seat for driving the nozzle assembly to rotate in the horizontal direction to adjust azimuth. The swing motor is connected to a transmission arm, thereby driving a rotary shaft connected with the transmission arm to rotate and finally making the nozzle assembly rotate on a horizontal plane along with an upper part of the base seat on which the nozzle assembly is fixed.

Preferably, the base seat is provided with a connecting member for fixing the device for blowing air in place.

A housing of the base seat may be provided with a fixing component for fixing the device for blowing air in place.

The device for blowing air may further include a USB port arranged on the base seat, comprising a standard or a mini-USB port.

Preferably, the upper part of the base seat, in which the air supply assembly is fixed, obtains power to drive the air supply assembly from a lower part of the base seat by means of a double-pole coaxial slip ring that can slideably rotate at a rotation centre on the bottom.

An airflow passage is connected between the nozzle assembly and the base seat in this invention. An intake end of the airflow passage is opened on the outer surface of the base seat, and an output end is connected to the nozzle assembly by means of a pivot component. The base seat supplies an air stream to the nozzle assembly by way of the airflow passage. Two pivot components are connected between the nozzle assembly and the base seat, and the nozzle assembly is rotatably connected to the base seat by the two pivot components, thereby realizing pitch rotation of the nozzle assembly around base seat at a large angle and satisfying the demands for adjustment of jet direction of the air stream. Furthermore, when the device for blowing air is idle, the nozzle assembly can be rotated and folded to a flat state so as to save space.

DETAILED DESCRIPTION OF THE INVENTION

Figure 1:
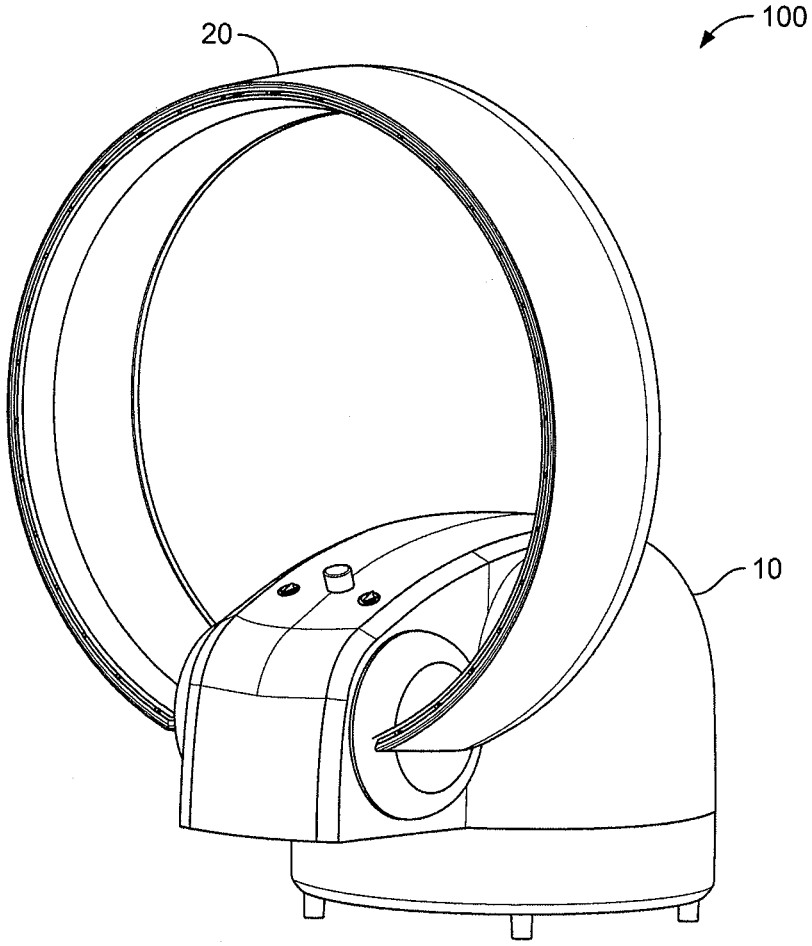
FIG. 1 is a schematic perspective view illustrating the structure of a foldable bladeless fan of the present invention.

To make the objectives, technical solutions and advantages of this invention understandable clearly, the invention is described in further detail below in conjunction with the drawings and embodiments. It should be understood that the embodiments are described for explaining this invention only and are not intended to limit the scope of this invention.

Referring to FIGS. 1-4, a device 100 for blowing air by means of a slot-shaped nozzle of a nozzle assembly is provided. The device includes a base seat 10 for generating an air stream to supply air flow and a nozzle assembly 20 supported by the base seat 10, the nozzle assembly comprising a slot-shaped opening for blowing air. An airflow passage is connected between the base seat 10 and the nozzle assembly 20. An intake end of the airflow passage is opened on the outer surface of the base seat 10, and an output end of the airflow passage is connected to the nozzle assembly 20 by means of a pivot component 21. An intake end of the nozzle assembly 20 is connected to an output end of the base seat 10 by means of the pivot component 21. An impeller 13 and an electric motor 12 for driving the impeller 13 to rotate are provided within the base seat 10. The nozzle assembly 20 is rotatably fixed on the base seat 10 by means of the pivot component 21.

The nozzle assembly is rotatably fixed on the base seat by means of the pivot component at any orientation. In particular, the nozzle assembly is rotatably fixed on the base seat by means of the pivot component at an elevation angle of 0-360°.

In practical use, the air stream generated by the base seat 10 is continuously injected into the nozzle assembly 20 through the airflow passage, so as to form a jetting air stream. In an embodiment of this invention, the base seat 10 is provided with a casing 11 therein, and an electric motor 12 and an impeller 13 connected to a rotary shaft of the electric motor 12 are accommodated in the casing 11. The electric motor 12 when rotating drives the impeller 13 to rotate, so as to generate the air stream. The impeller 13 and the electric motor 12 are coaxially accommodated in the casing within the base seat 10 to constitute an air supply assembly for generating an air stream, and an air filter assembly is installed at the opening of the intake end of the airflow passage on the casing.

The pivot component 21 includes a T-shaped hollow pipe installed in the base seat 10, and two ends 32 of a horizontal pipe of the T-shaped hollow pipe are in communication with the intake end of the nozzle assembly 20. An intake end 31 of a vertical pipe of the T-shaped hollow pipe is in communication with the output end of the base seat. The two ends 32 of the horizontal pipe are respectively socketed with a flange that is rotatable around the horizontal pipe, and the flange and the nozzle assembly 20 are fixed together, so that the nozzle assembly 20 and the flange rotate around the horizontal pipe together. A sealing member is arranged between the flange and the horizontal pipe, and a fastener is connected between the flange and the nozzle assembly.

In another embodiment, the pivot component 21 includes a hollow pipe arranged at the intake end of the nozzle assembly 20. The hollow pipe and the nozzle assembly are fixed together, and a sealing member is arranged between the hollow pipe and an air outlet of the casing within the base seat, so that the nozzle assembly and the hollow pipe rotate together.

Preferably, a sealing member is arranged between the flange or the hollow pipe and the casing within the base seat to prevent the air stream out of the air supply assembly from escaping and influencing the air supply efficiency.

A circlip is arranged on the flange or the hollow pipe to prevent the nozzle assembly from disengaging from the casing within the base seat.

Figure 2B:
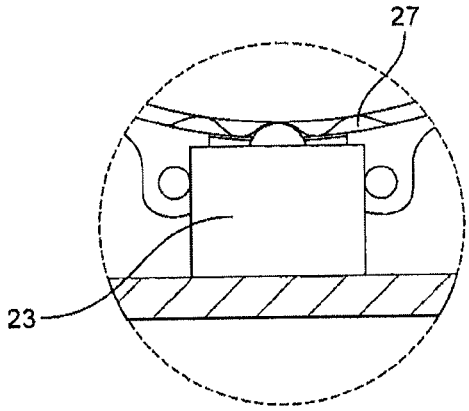
FIG. 2B is a partial enlarged view of the structure in FIG. 2A.
Figure 3A:
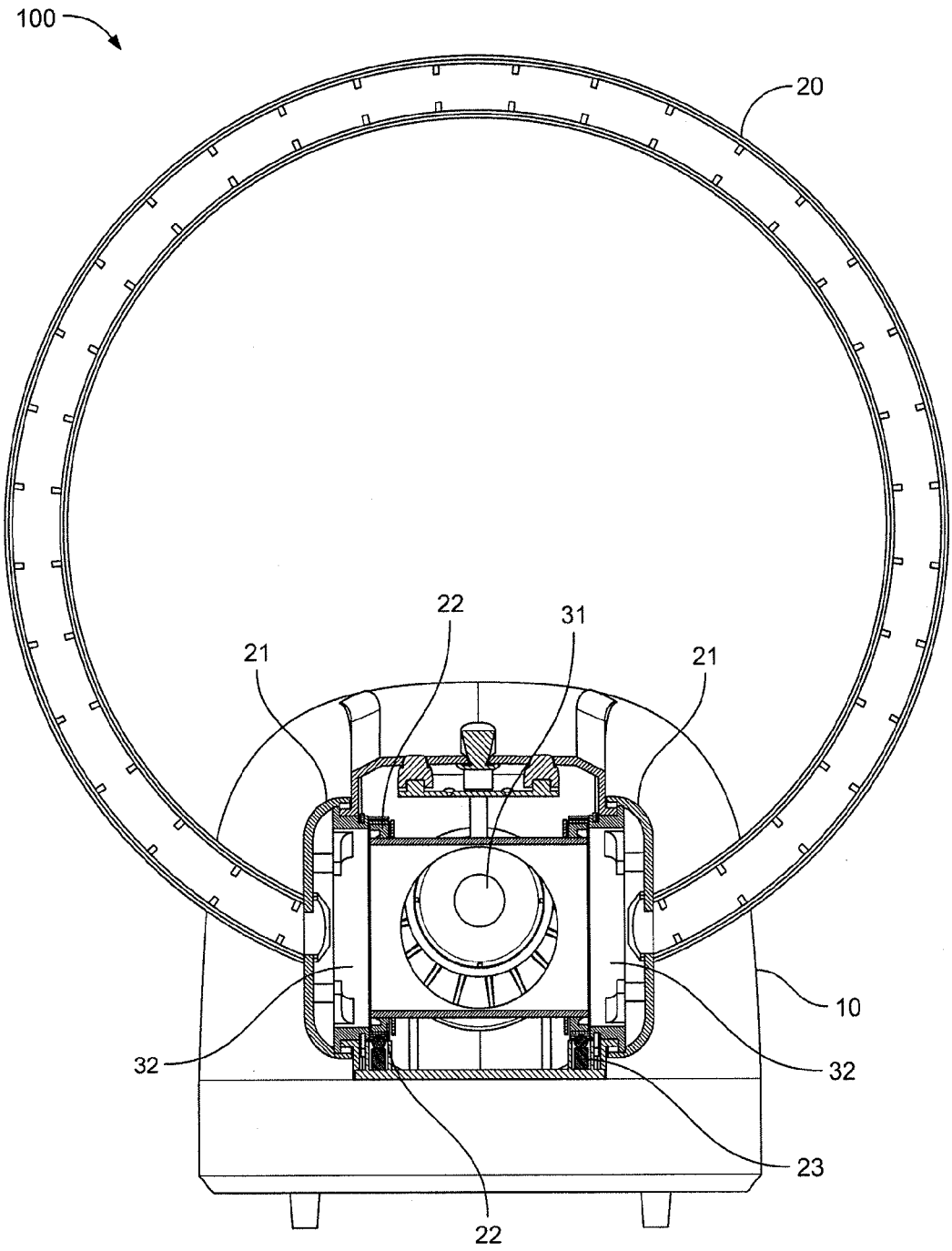
FIG. 3A is a cross-sectional front view illustrating the structure of the foldable bladeless fan of the present invention.
Figure 3B:
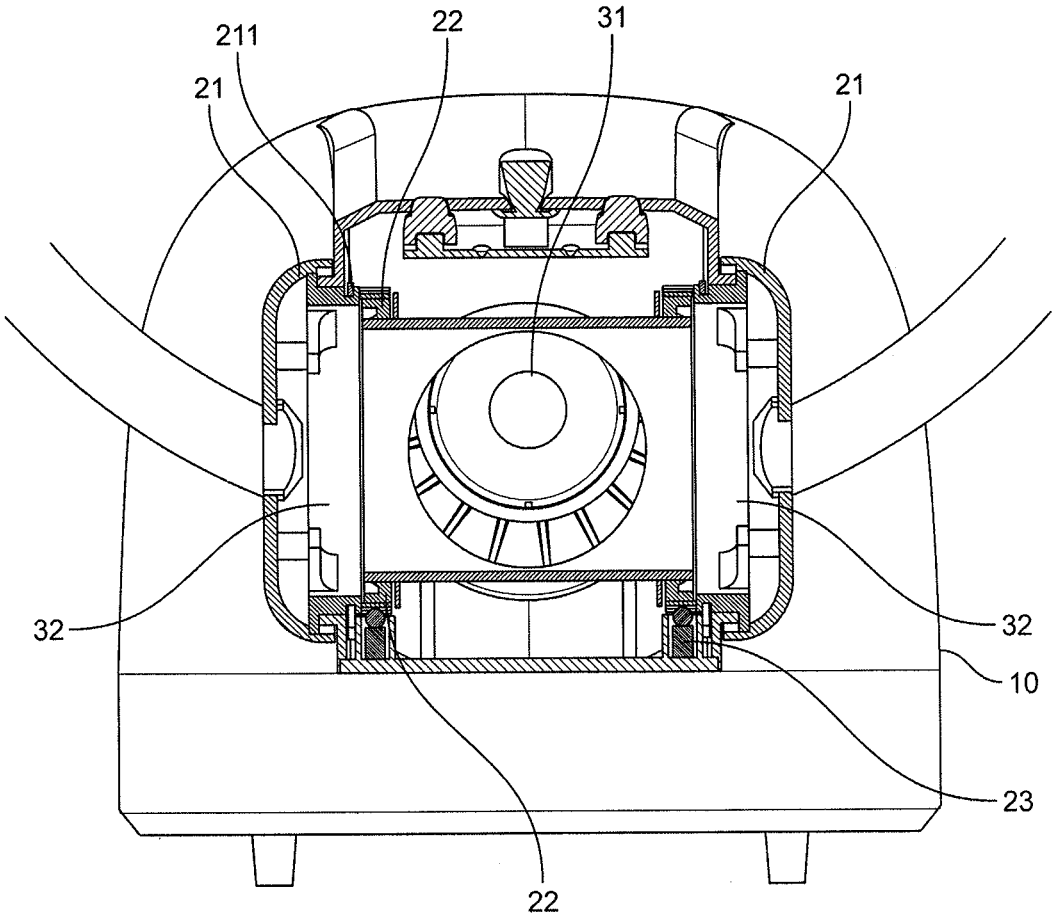
FIG. 3B is a partial enlarged view of the structure in FIG. 3A.
Figure 4:
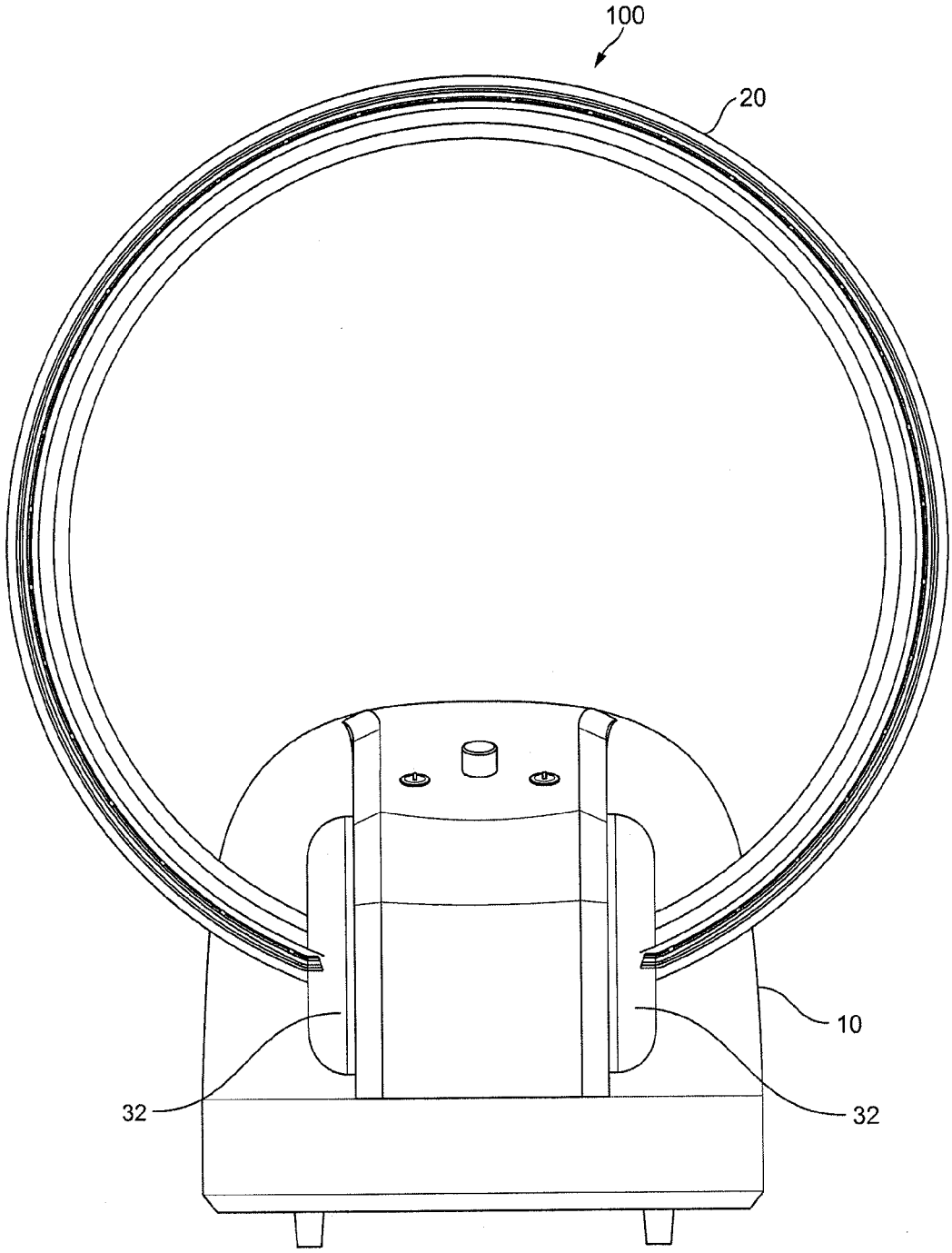
FIG. 4 is a schematic front view illustrating the structure of the foldable bladeless fan of the present invention.
Figure 5A:
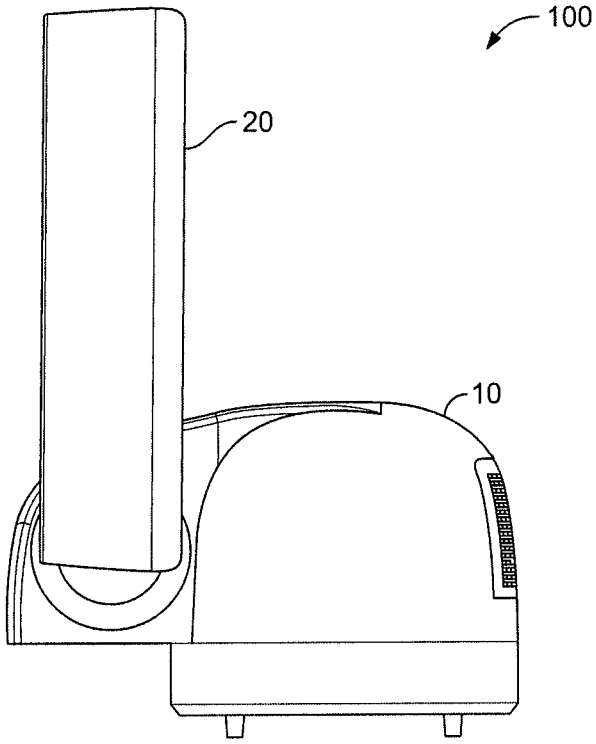
FIG. 5A is a schematic structural view illustrating a first state of an embodiment of the present invention.
Figure 5B:
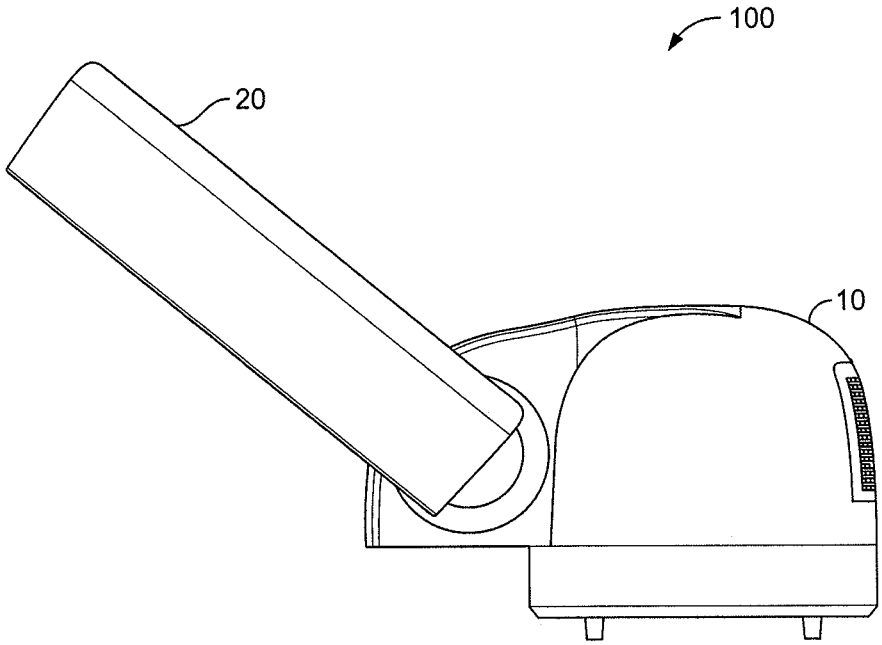
FIG. 5B is a schematic structural view illustrating a second state of an embodiment of the present invention.
Figure 5C:
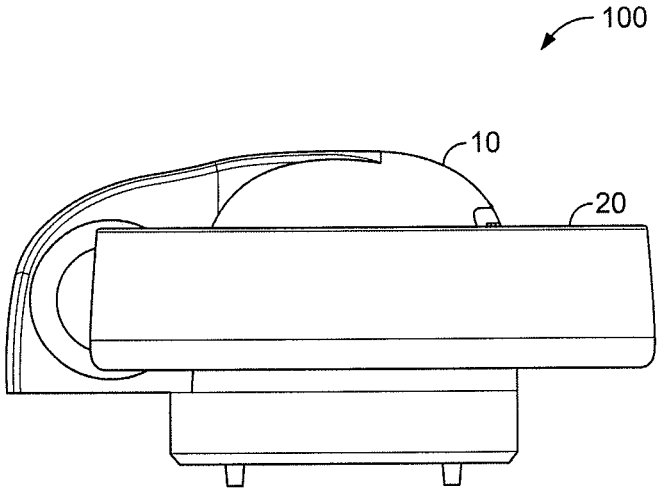
FIG. 5C is a schematic structural view illustrating a third state of an embodiment of the present invention.

The casing 11 is connected to the intake end 31 by a connecting pipe 14, the connecting pipe 14 is fixed on the base seat 10, and the nozzle assembly 20 is connected to two ends 32 of the horizontal pipe of the T-shaped hollow pipe. With the above connection structure, the air stream generated in casing 11 enters the intake end 31 of the vertical pipe through the connecting pipe 14, and then enters the nozzle assembly 20 through the two ends 32 of the horizontal pipe to be jetted. The air stream that enters the nozzle assembly 20 follows Bernoulli's principle, that is, when the impeller 13 drives air to generate the air stream, the air stream enters a ring passage of the nozzle assembly 20 through the two ends 32 of the horizontal pipe and then is jetted from the nozzle assembly 20 to form the jetting air stream. It should be explained that a pivot component 21 is arranged at the points of connection between the nozzle assembly 20 and the two ends 32 of the horizontal pipe, and the nozzle assembly 20 is rotatably connected to the two ends 32 of the horizontal pipe by the pivot component 21, so as to realize the pitch rotation of the nozzle assembly 20 around the horizontal pipe at a large angle, and thus the device 100 for blowing air by means of the nozzle assembly can output the air stream to a user at multiple orientations and at any position. With reference to FIGS. 5A-5C, the device can be placed on a floor, table, and vertical wall by simply adjusting the installation orientation and the pitch angle of the nozzle assembly 20. Meanwhile, when the device 100 for blowing air by means of the nozzle assembly is idle, the angle of the nozzle assembly 20 can be adjusted to lie flat around the periphery of the base seat 10 so as to further save space. Preferably, a sealing ring 22 is arranged at the points of connection between the flanges and the two ends 32 of the horizontal pipe for enclosing the air stream to achieve a better air stream circulation effect. At the same time, the pivot component 21 is connected with an assembly 23 that facilitates smooth rotation of the nozzle assembly, and the assembly 23 includes springs fixed in the casing of the base seat and roller balls placed on the springs, as shown in FIGS. 2B and 3B. A rounded toothed connecting section is arranged on the outer circumference of each flange, and each roller ball rests against a concave portion 27 of a respective toothed connecting section, thereby facilitating smooth rotation of the nozzle assembly around the horizontal pipe.

Alternatively, the pivot component 21 may be connected with a plastic part that facilitates smooth rotation of the nozzle assembly, protrusions are arranged at the plastic part corresponding to the rounded toothed connecting section of the flange, and the protrusions rest against each concave portion 27 of the toothed connecting section, thereby facilitating smooth rotation of the nozzle assembly around the horizontal pipe.

Referring to the embodiment as shown in FIG. 2A again, an air filter assembly 151 is arranged at the opening 15 of the intake end of the airflow passage on the surface of the base seat 10.

In another embodiment, the impeller 13 and the electric motor 12 are coaxially accommodated in a casing within the base seat 10 to constitute an air supply assembly for generating an air stream, and an air filter assembly is installed at the opening of the intake end of the airflow passage on the casing.

Of course, the air filter assembly may be arranged between the opening of the intake end of the airflow passage on the surface of the base seat 10 and the casing of the air supply assembly.

Preferably, the air filter assembly is detachably installed at the opening of the intake end of each airflow passage, for the convenience of cleaning and replacement in time when there is a large amount of dust adhering to the air filter assembly to realize the repetitive use of the air filter assembly. Obviously, the air filter assembly can also be fixed at the opening of the intake end of each airflow passage.

The air filter assembly is a mesh filter, a filter laminate or a filter cartridge based on the filter laminate.

Preferably, the impeller 13 is provided with a protective cover 131 outside for reducing noise generated when the impeller 13 is operating. As shown in the figure, F indicates the direction of air flow. The air filter device 151 may be an automatic, centrifugal, electrostatic, pulse filter device, or air filter. Obviously, any filter devices that can achieve the effect of filtering air and reducing the amount of dust getting into the device 100 for blowing air may be used. Therefore, the air filter assembly can reduce the amount of dust getting into the fan, prevent the dust from adhering to the components inside the fan, guarantee unimpeded flow in the airflow passage of the fan and keep the interior of the fan clean, so that the device 100 for blowing air has an extended operational lifespan.

Figure 6:
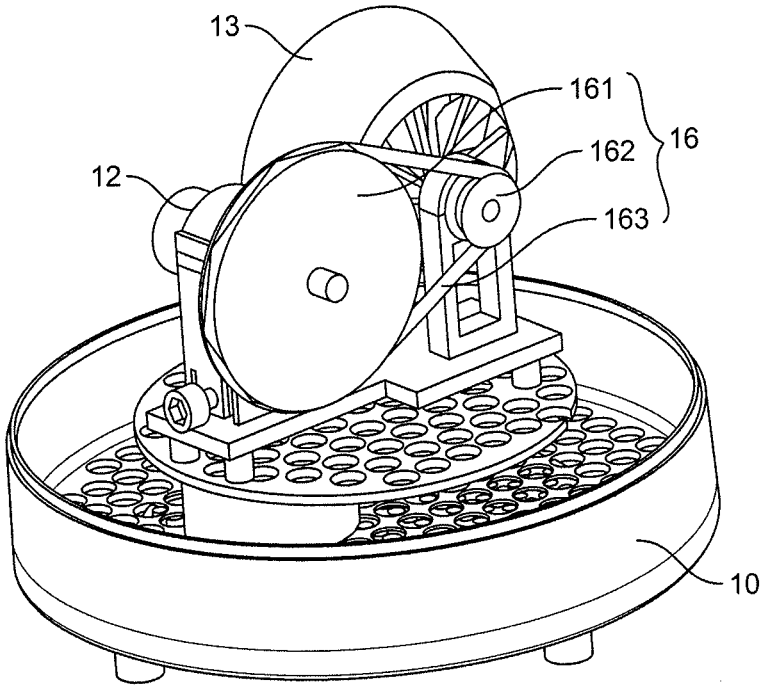
FIG. 6 is a schematic view of the structure inside a base seat of the present invention.

FIG. 6 is a schematic view of the structure inside the base seat 10 of another embodiment of the present invention. Referring to FIG. 6, an accelerating transmission mechanism is installed on an output shaft of the electric motor 12 for driving the impeller 13 to rotate in the base seat 10 and includes a pulley drive and a gear pair transmission mechanism. Specifically, the base seat 10 is provided with a transmission mechanism 16 inside that enables the electric motor 12 and the impeller 13 to have different rotational speeds, and the electric motor 12 and the impeller 13 are connected by the transmission mechanism 16. The transmission mechanism 16 has a fixed transmission ratio that enables the rotational speed of the impeller 13 to be higher than that of the electric motor 12. A small rotational speed of the electric motor 12 can achieve a large rotational speed of the impeller 13, thereby lowering the requirement for the electric motor 12. The electric motor 12 can achieve a noise reduction effect by choosing an ordinary electric motor of low cost, and thus a high-cost brushless DC electric motor becomes unnecessary.

Figure 7:
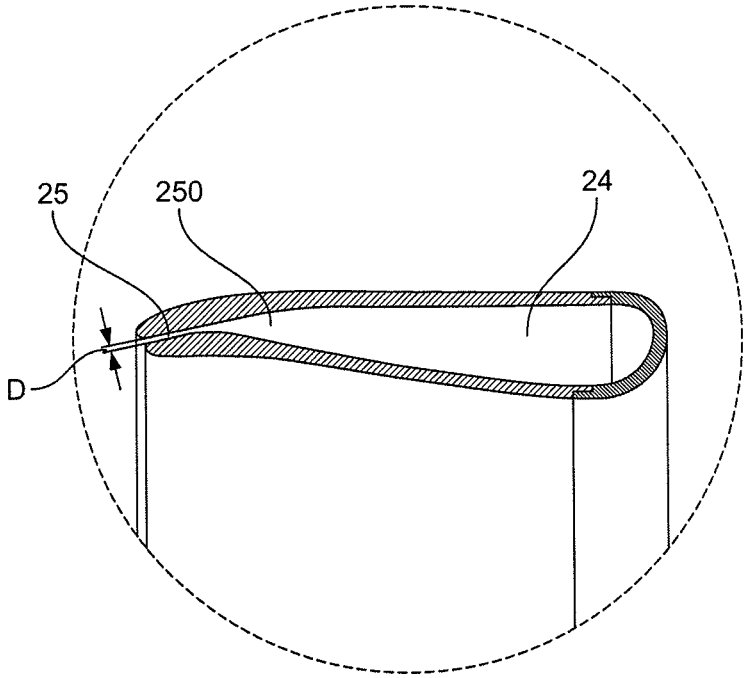
FIG. 7 is a partial enlarged schematic structural view illustrating a nozzle in an embodiment of the present invention.

The transmission mechanism 16 includes a first transmission part 161, a second transmission part 162, and a transmission belt 163. The transmission belt 163 is fitted on the first transmission part 161 and the second transmission part 162, so that the transmission belt 163 forms a transmission relation between the first transmission part 161 and the second transmission part 162. When the first transmission part 161 rotates, the second transmission part 162 is driven by the transmission belt 163 to rotate. The first transmission part 161 is coaxially connected to the drive shaft of the electric motor 12, and the second transmission part 162 is connected to the rotary shaft of impeller 13. Therefore, when the bladeless fan 100 operates, the electric motor 12 drives the first transmission part 161 to rotate, and the second transmission part 162 also rotates by means of the transmission relation between the first transmission part 161 and the second transmission part 162 and drives the impeller 13 to rotate. Meanwhile, the transmission ratio of the first transmission part 161 and the second transmission part 162 needs to be greater than 1, so as to guarantee that the electric motor 12 at a small rotational speed drives the impeller 13 to develop a large rotational speed. Obviously, the first transmission part 161 and the second transmission part 162 may be connected in other ways such as teeth engagement in which a gear is used to drive the impeller 13 to rotate, or the two directly rest against each other and the impeller 13 is driven to rotate by frictional resistance. Of course, the two transmission parts may be connected by belt or chain to form the driving assembly. In this embodiment, the rotational speed of the electric motor 12 is no more than 5000 rpm, and the rotational speed of the impeller 13 is no more than 30000 rpm. Referring to FIG. 7, the nozzle assembly 20 is overall shaped like a round or oval ring with a constant section and includes a rectifier ring 24 for receiving the air stream in the assembly inner cavity and a slot-shaped nozzle 25 for blowing air arranged on an outer ring circumference or an oval circumference.

The rectifier ring 24 includes a gradually narrowing tapered area 250 and the slot-shaped nozzle 25 for blowing air is located at a tip of the tapered area 250. In this embodiment, the distance between two opposing surfaces for limiting a width of the slot-shaped nozzle 25 for blowing air is 0.2-15.0 mm, the angle formed between the air blowing direction of the air supply part of the nozzle and the central axis of the rectifier ring is 0.2-20.0°, and the length of the air supply part in the air blowing direction is 0.2-30.0 mm.

Figure 8:
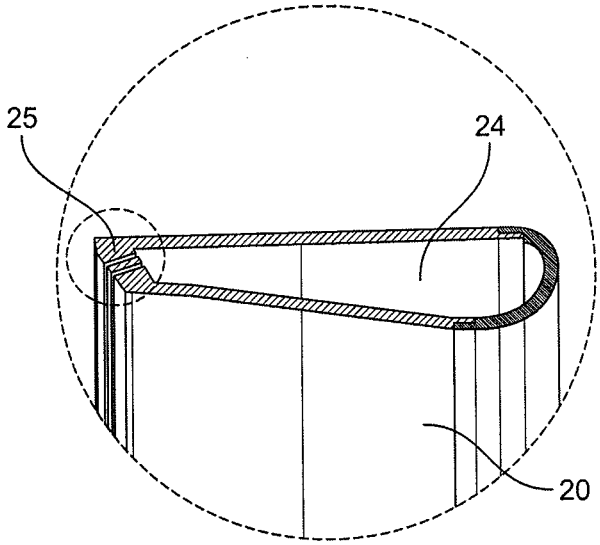
FIG. 8 is a partial enlarged schematic structural view illustrating a nozzle in another embodiment of the present invention.
Figure 9:
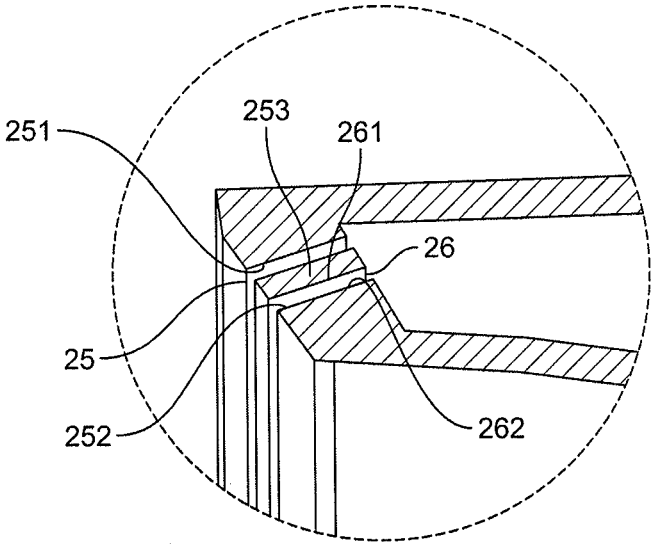
FIG. 9 is a partial enlarged view illustrating air supply outlets and a partition board in FIG. 8.

FIG. 8 is an enlarged schematic view illustrating a partial structure of the nozzle assembly 20 in another embodiment of the present invention. Referring to FIG. 8, the two opposing surfaces for limiting the width of the slot-shaped nozzle 25 for blowing air are separated by at least one partition board extending along the nozzle, and the partition board is connected to the two opposing surfaces by a fixing member to form multiple rows of air supply outlets extending along the nozzle. Two adjacent rows of air supply outlets are arranged in alignment or in a staggered manner. Each air supply outlet includes opposing surfaces for limiting each air supply outlet, the sum of the distances between each pair of opposing surfaces is 0.2 mm-15 mm, the angle formed between the air blowing direction of the air supply part of the nozzle and the central axis of the rectifier ring is 0.2-20.0°, and the length of the air supply part in the air blowing direction is 0.2-30.0 mm. Specifically, the nozzle 25 includes two limiting walls 251 and 252 for limiting the width of the nozzle 25. The two limiting walls 251 and 252 are separated by at least one partition board 253 extending along the nozzle 25, and the partition board 253 is connected to the two limiting walls 251 and 252 of the nozzle 25 by the fixing member, thereby forming multiple rows of air supply outlets 26 (in a grille design) extending along the nozzle 25. The fixing member, partition board 253 and the two limiting walls 251 and 252 of the nozzle 25 are integrally formed. The air supply outlets 26 may be arranged in two or multiple rows; moreover, the multiple rows of air supply outlets 26 jet air streams at the same time, so that the air stream jetted by the nozzle 25 substantially forms an annular shape, thereby generating a more even and soft air stream with a large area. The air supply outlets 26 include opposing surfaces 261 and 262 for limiting the outlets; the sum of distances between the opposing surfaces of the multiple rows of air supply outlets 26 is preferably 0.2 mm-15 mm, and the angle formed between the air supply outlets 26 and the axis X of the rectifier ring 24 is preferably 0.2-20°. The length of the air supply outlets 26 is preferably 0.2 mm-30 mm. The air streams jetted by the multiple rows of air supply outlets 26 are forced to converge on the axis X under guidance, so the air stream generated by the nozzle assembly 20 is jetted forwards substantially in the form of a ring or annular shape and the air stream is more concentrated, thereby reducing the loss of the energy and speed of the air stream, and the user when located far from the bladeless fan 100 can still enjoy the cool air.

Figure 2A:
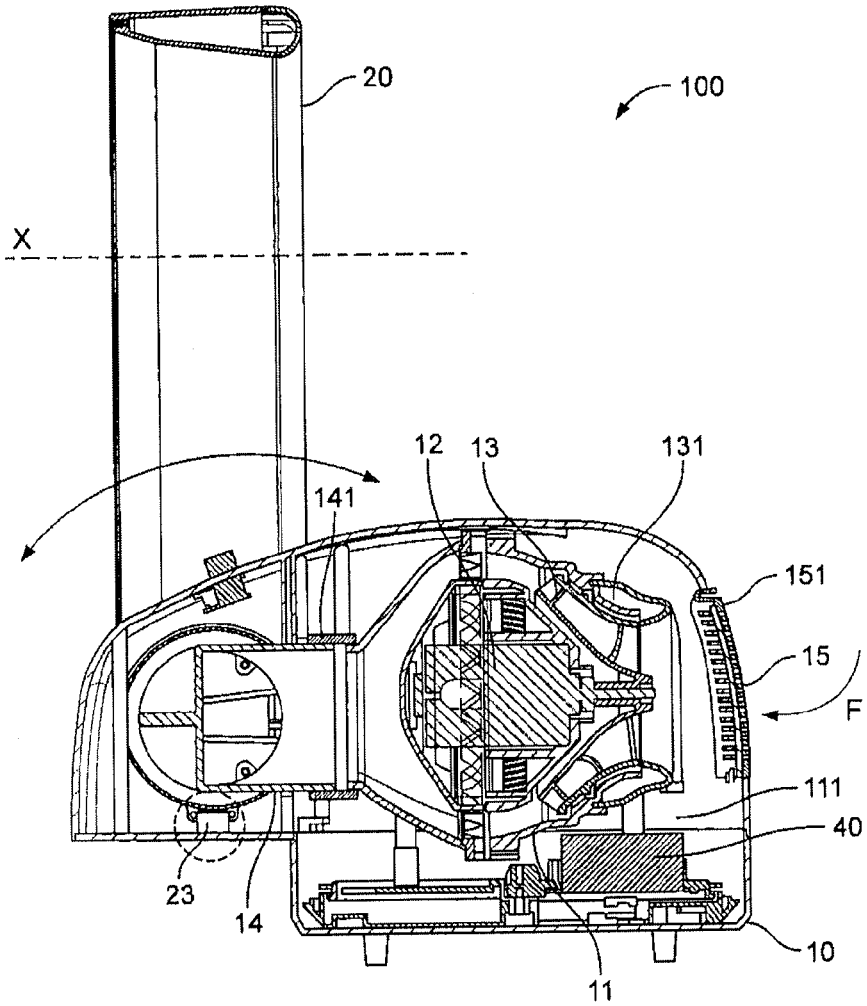
FIG. 2A is a schematic cross-sectional side view illustrating the structure of the foldable bladeless fan of the present invention.

Preferably, in the base seat 10 with reference to FIG. 2A, the electric motor 12 and impeller 13 are both accommodated in the casing 11 to form an air supply assembly, and a shock-absorption connecting member is arranged between the casing 11 and the intake end of the airflow passage. Specifically, the casing 11 is connected to the intake end 31 by the connecting pipe 14, and a buffering connecting member 141 for buffering shock is connected at the position where the casing 11 and the connecting pipe 14 are connected, and thus the connecting pipe 14 and the casing 11 are connected in a better way. Preferably, the casing 11 is fixed within the base seat 10 by a shock-absorption mechanism 111. When the electric motor 12 is operating, the base seat 10 is prevented from shaking severely and generating large noise.

Figure 10:
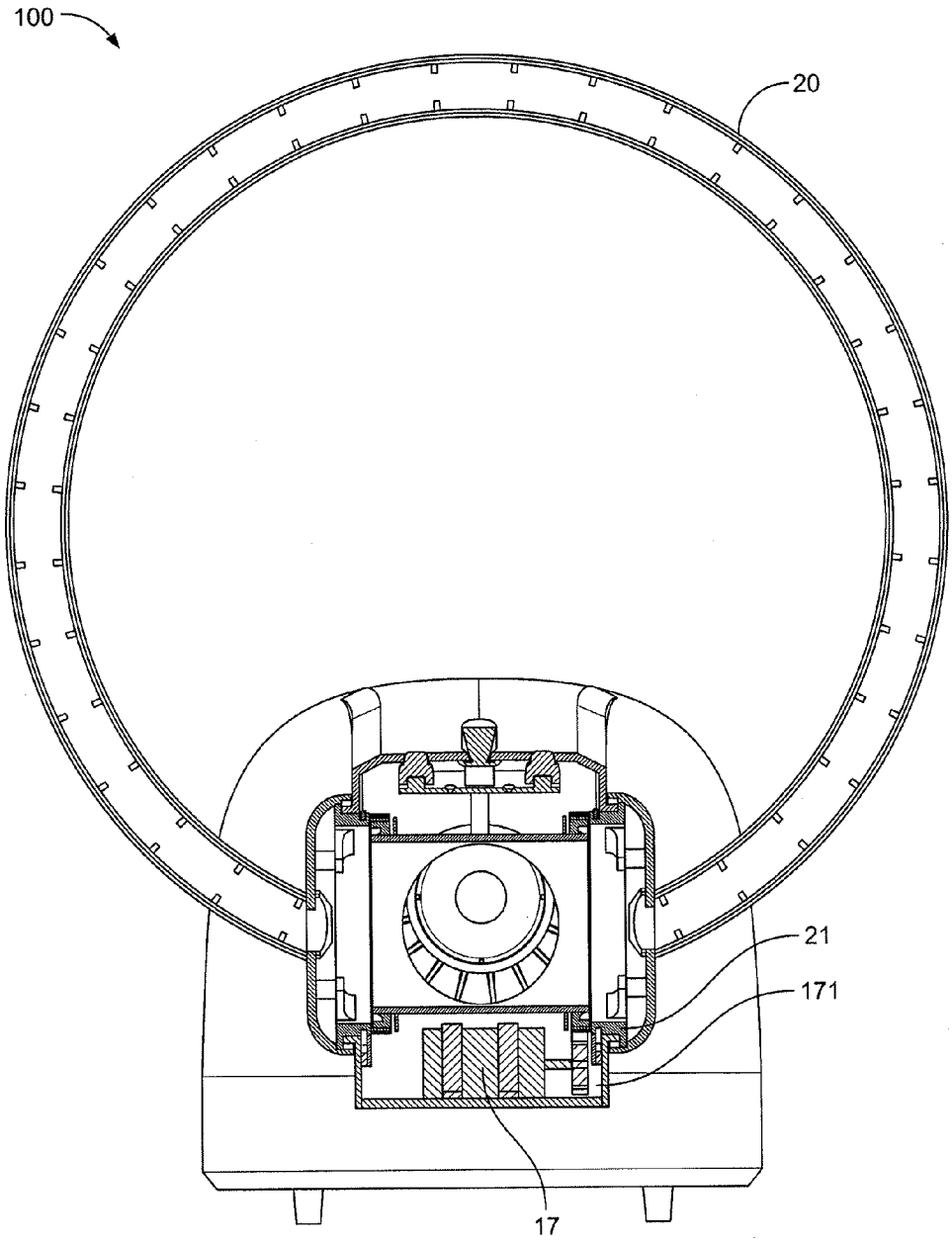
FIG. 10 is a cross-sectional front view illustrating the structure in another embodiment of the present invention.

FIG. 10 is a schematic structural view illustrating the device 100 for blowing air of another embodiment of this invention. A secondary electric motor 17 for controlling pitch rotation of the nozzle assembly 20 and at least one drive wheel 171 connected to the output shaft of the secondary electric motor 17 are provided in the casing within the base seat 10, and the drive wheel 171 when engaged with the pivot component 21 makes the nozzle assembly 20 rotate smoothly. More specifically, in this embodiment, a secondary electric motor 17 and a drive wheel 171 connected to the secondary electric motor 17 are provided in the base seat 10, and the drive wheel 171 rests against the pivot component 21 of the nozzle assembly 20. The secondary electric motor 17 when operating drives the drive wheel 171 to rotate and in turn drive the pivot component 21 to rotate, thereby achieving the pitch rotation of the nozzle assembly 20. The user can control the pitch of the nozzle assembly 20 by simply using a control (remote control) button of the secondary electric motor 17 without any other effort.

Figure 11:
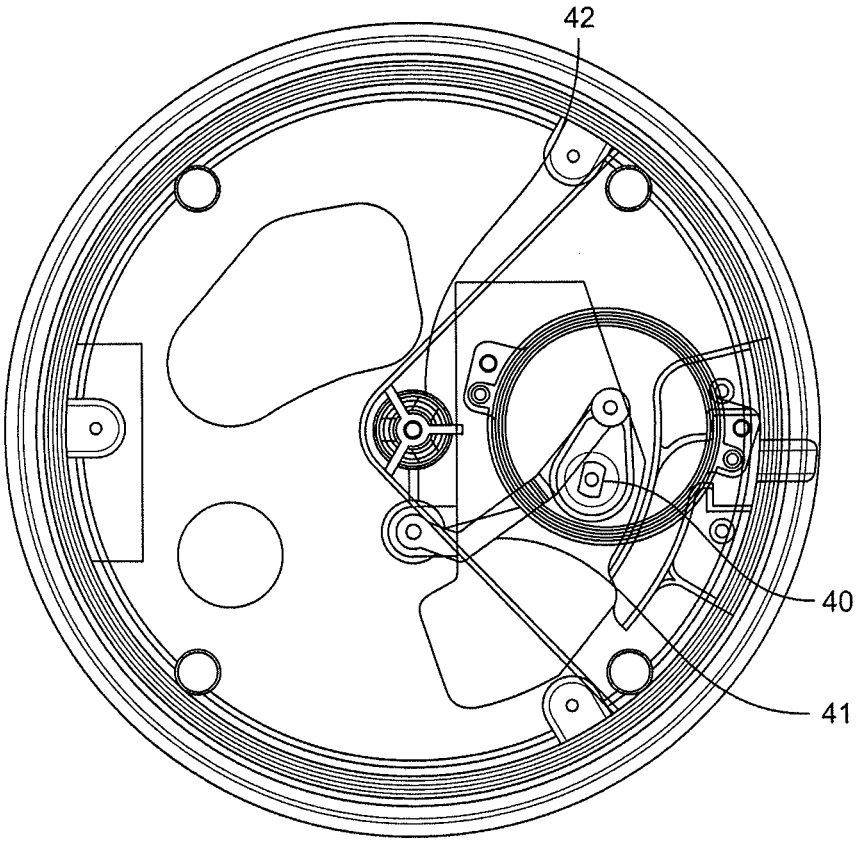
FIG. 11 is a schematic view illustrating a rotation adjustment structure of a base seat of the foldable bladeless fan of the present invention.

The device 100 for blowing air further includes a swing motor 40 disposed in the base seat 10 for driving the nozzle assembly 20 to rotate in the horizontal direction to adjust the azimuth. The swing motor 40 is connected to a transmission arm 41, thereby driving a rotary shaft connected with the transmission arm 41 to rotate and finally making the nozzle assembly 20 rotate on a horizontal plane along with an upper part of the base seat on which the nozzle assembly 20 is fixed. Referring to FIG. 11 for details, the transmission arm 41 is connected to the rotary shaft 42, and when the swing motor 40 is controlled to operate, the swing motor 40 drives the transmission arm 41 to rotate in an arc and further drives the rotary shaft 42 to rotate, so that the upper part of the base seat 10 drives the nozzle assembly 20 to rotate on a horizontal plane.

Figure 12:
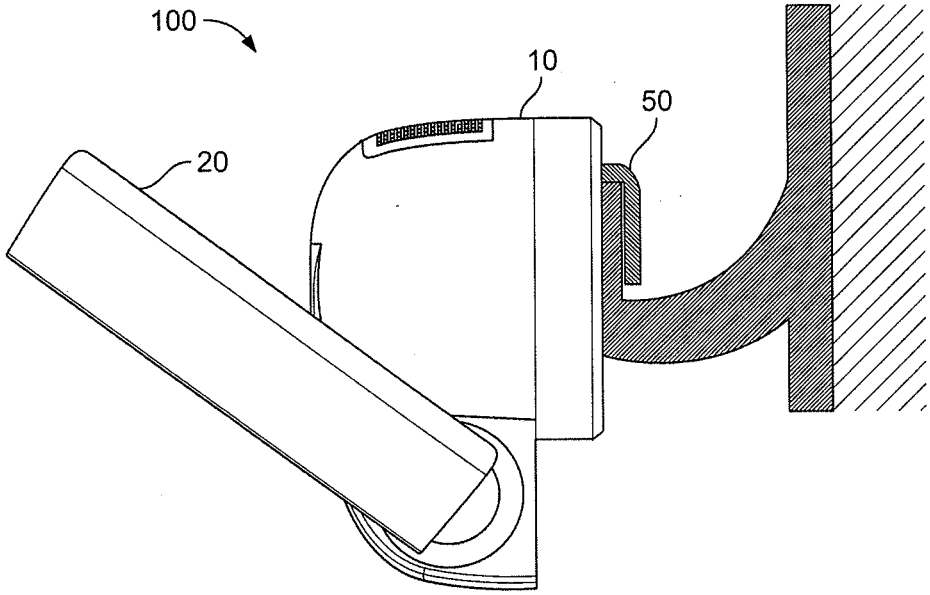
FIG. 12 is a schematic view illustrating a hanging structure of an embodiment of the present invention.

The base seat of the device 100 for blowing air is provided with a connecting member for fixing the device for blowing air in place, so that the device 100 for blowing air may be placed on a floor, table, and vertical installment body. In other words, a housing of the base seat 10 is provided with a fixing component for fixing the device 100 for blowing air in place; as shown in FIG. 12, it is fixed on the wall by a buckle member 50. Obviously, the fixing component may also be a screw, bracket, or the like.

Figure 13A:
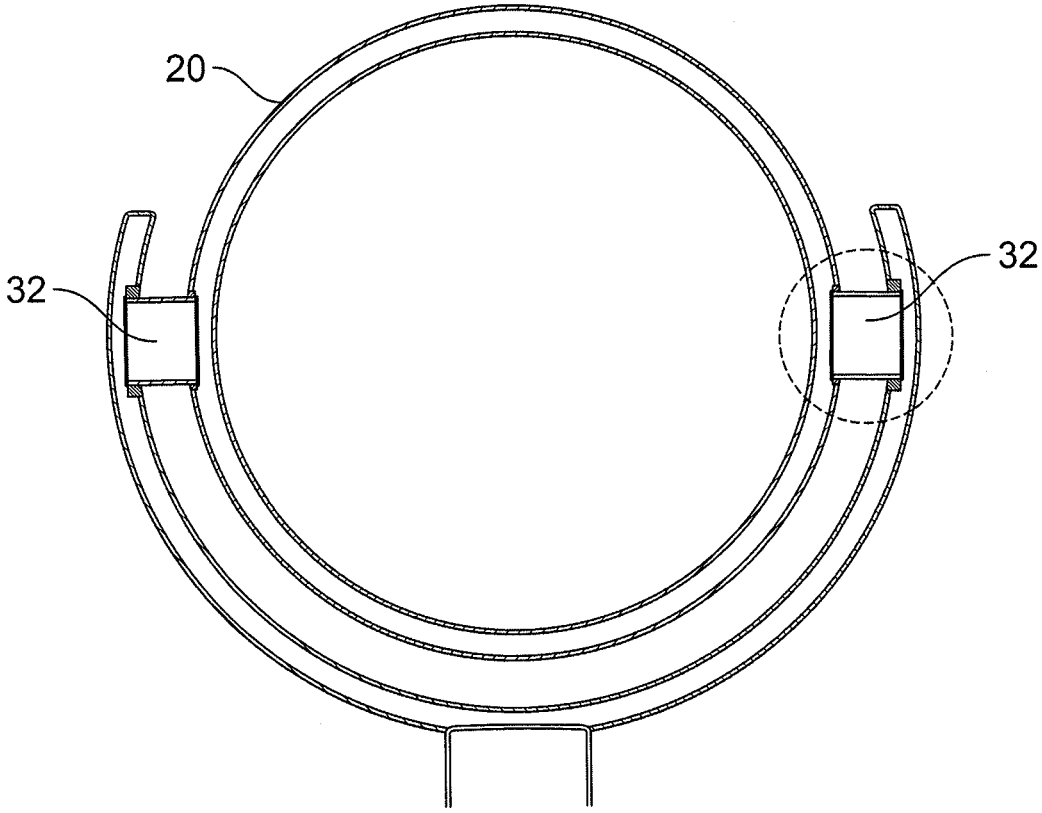
FIG. 13A is a schematic view illustrating a partial structure of another embodiment of the present invention.
Figure 13B:
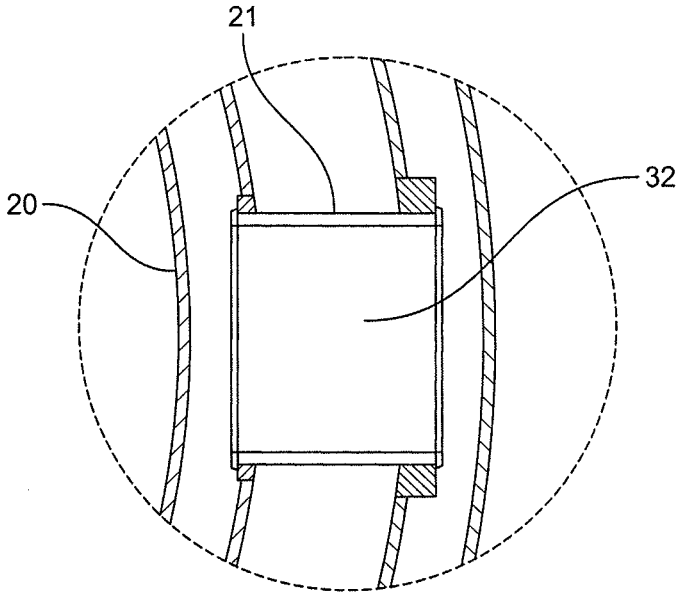
FIG. 13B is a schematic partial enlarged view illustrating the structure in FIG. 13A.

Of course, this invention is not limited to the above structure. Referring to FIGS. 13A and 13B, the profile of the deformed horizontal pipe of the T-shaped pipe is substantially a semicircle that matches the lower part of the nozzle assembly 20. The two discharge ends 32 of the semicircular passage are respectively provided with the pivot component 21, and the nozzle assembly 20 is rotatably disposed on the two discharge ends 32 of the semicircular passage by means of the pivot components 21. In this embodiment, the nozzle assembly 20 can rotate freely in a range of 360° around the pivot component 21 that is taken as the axis of rotation, so that the device 100 for blowing air can output the air stream for the user at any orientation and any position.

In another embodiment, this device 100 for blowing air further includes a USB port arranged on the base seat, comprising a standard or a mini-USB port.

In still another embodiment, the upper part of the base seat 10, in which the air supply assembly is fixed, obtains power from the lower part of the base seat to drive the air supply assembly by means of a double-pole coaxial slip ring that can slideably rotate at a rotation centre on the bottom.

In summary, this invention realizes the pitch rotation of the nozzle assembly 20 around the base seat 10 at a large angle, thereby satisfying the demands for adjustment of jetting direction of the air stream. Moreover, when the device for blowing air is idle, the nozzle assembly can be rotated and folded to a flat state so as to save space.

The invention claimed is:

1. A device for blowing air by a nozzle assembly, comprising a base seat for generating an air stream to supply air flow and the nozzle assembly is supported by the base seat, the nozzle assembly comprising a slot-shaped opening for blowing air, wherein an airflow passage is connected between the base seat and the nozzle assembly, an intake end of the airflow passage is opened from an outer surface of the base seat, and an output end of the airflow passage is connected to the nozzle assembly by a pivot component; an intake end of the nozzle assembly is connected to an output end of the base seat by the pivot component; an impeller and an electric motor for driving the impeller to rotate are provided within the base seat, the nozzle assembly is rotatably fixed on the base seat by the pivot component; the pivot component includes a T-shaped hollow pipe installed within the base seat, two ends of a horizontal pipe of the T-shaped hollow pipe are in communication with the intake end of the nozzle assembly; a vertical pipe of the T-shaped hollow pipe is in communication with the output end of the base seat; the two ends of the horizontal pipe are respectively socketed with a flange that rotates around the horizontal pipe, and the flange and the nozzle assembly are fixed together, so that the nozzle assembly and the flange rotate around the horizontal pipe together.

2. The device for blowing air of claim 1, wherein the nozzle assembly is rotatably fixed on the base seat by the pivot component at any orientation.

3. The device for blowing air of claim 1, wherein the nozzle assembly is rotatably fixed on the base seat by the pivot component at an elevation angle of 0-360°.

4. The device for blowing air of claim 1, wherein an air filter assembly is arranged at an opening of the outer surface of the base seat at the intake end of the airflow passage.

5. The device for blowing air of claim 4, wherein the air filter assembly is a mesh filter, a filter laminate, or a filter cartridge based on the filter laminate.

6. The device for blowing air of claim 1, wherein the impeller and the electric motor are coaxially accommodated in a casing within the base seat to constitute an air supply assembly for generating an air stream, and an air filter assembly is installed at an opening of the casing at the intake end of the airflow passage.

7. The device for blowing air of claim 4 or 6, wherein the air filter assembly is detachably installed at the intake end of the airflow passage.

8. The device for blowing air of claim 1, wherein the impeller and the electric motor are coaxially accommodated in a casing within the base seat to constitute an air supply assembly for generating an air stream, and an air filter assembly is provided between an opening of the outer surface of the base seat at the intake end of the airflow passage and an opening of the casing of the air supply assembly at the intake end of the airflow passage.

9. The device for blowing air of claim 1, wherein an accelerating transmission mechanism is installed on an output shaft of the electric motor for driving the impeller to rotate in the base seat and includes a pulley drive and a gear pair transmission mechanism.

10. The device for blowing air of claim 1, wherein the nozzle assembly is overall shaped like a round or oval ring with a constant section and includes a rectifier ring for receiving the air stream in an inner cavity of the assembly, the slot-shaped nozzle for blowing air being arranged on an outer ring circumference or an oval circumference.

11. The device for blowing air of claim 10, wherein the rectifier ring includes a gradually narrowing tapered area and the slot-shaped nozzle for blowing air is located at a tip of the tapered area.

12. The device for blowing air of claim 11, wherein a distance between two opposing surfaces for limiting a width of the slot-shaped nozzle for blowing air is 0.2-15.0 mm, an angle formed between an air blowing direction of an air supply part of the nozzle and a central axis of the rectifier ring is 0.2-20.0°, and a length of the air supply part in the air blowing direction is 0.2-30.0 mm.

13. The device for blowing air of claim 11, wherein two opposing surfaces for limiting the width of the slot-shaped nozzle for blowing air are separated by at least one partition board extending along the nozzle, and the partition board is connected with the two opposing surfaces by a fixing member to form multiple rows of air supply outlets extending along the nozzle; two adjacent rows of air supply outlets are arranged in alignment or in a staggered manner; each air supply outlet includes opposing surfaces for limiting each air supply outlet, the sum of distances between each pair of opposing surfaces is 0.2 mm-15 mm, an angle formed between the air blowing direction of the air supply part of the nozzle and the central axis of the rectifier ring is 0.2-20.0°, and the length of the air supply part in the air blowing direction is 0.2-30.0 mm.

14. The device for blowing air of claim 1, wherein a sealing member is arranged between the hollow pipe and a casing within the base seat.

15. The device for blowing air of claim 1, wherein the pivot component is connected with an assembly that facilitates smooth rotation of the nozzle assembly and includes springs fixed in the casing of the base seat and roller balls placed on the springs; a rounded toothed connecting section is arranged on the outer circumference of each flange, and each roller ball rests against a concave portion of a respective toothed connecting section, thereby facilitating smooth rotation of the nozzle assembly around the horizontal pipe.

16. The device for blowing air of claim 1, wherein the pivot component is connected with a plastic part that facilitates smooth rotation of the nozzle assembly, protrusions are arranged at the plastic part corresponding to a rounded toothed connecting section of the flange, and the protrusions rest against each concave portion of the toothed connecting section, thereby facilitating smooth rotation of the nozzle assembly around the horizontal pipe.

17. The device for blowing air of claim 1, wherein a sealing member is arranged between the flange and the horizontal pipe, and a fastener is connected between the flange and the nozzle assembly.

18. The device for blowing air of claim 1, wherein a secondary electric motor for controlling pitch rotation of the nozzle assembly and at least one drive wheel connected to an output shaft of the secondary electric motor are provided in a casing within the base seat, and an engagement of the drive wheel with the pivot component makes the nozzle assembly rotate smoothly.

19. The device for blowing air of claim 1, wherein the electric motor and the impeller constitute an air supply assembly of the device for blowing air, the air supply assembly is accommodated in a casing, and the casing is fixed within the base seat through a damping mechanism.

20. The device for blowing air of claim 1, wherein the impeller and the electric motor are both accommodated in a casing to constitute an air supply assembly, and a shock-absorption connecting member is arranged between the casing and the intake end of the airflow passage.

21. The device for blowing air of claim 1, further comprising a swing motor disposed within the base seat for driving the nozzle assembly to rotate in the horizontal direction to adjust an azimuth, wherein the swing motor is connected to a transmission arm, thereby driving a rotary shaft connected with the transmission arm to rotate and finally making the nozzle assembly rotate on a horizontal plane along with an upper part of the base seat on which the nozzle assembly is fixed.

22. The device for blowing air of claim 21, wherein a housing of the base seat is provided with a fixing component for fixing the device for blowing air in place.

23. The device for blowing air of claim 1, wherein the base seat is provided with a connecting member for fixing the device for blowing air in place.

24. The device for blowing air of claim 1, further comprising a universal serial bus (USB) port arranged on the base seat, comprising a standard or a mini-USB port.

25. A device for blowing air by a nozzle assembly, comprising a base seat for generating an air stream to supply air flow and the nozzle assembly is supported by the base seat, the nozzle assembly comprising a slot-shaped opening for blowing air, wherein an airflow passage is connected between the base seat and the nozzle assembly, an intake end of the airflow passage is opened from an outer surface of the base seat, and an output end of the airflow passage is connected to the nozzle assembly by a pivot component; an intake end of the nozzle assembly is connected to an output end of the base seat by the pivot component; an impeller and an electric motor for driving the impeller to rotate are provided within the base seat, the nozzle assembly is rotatably fixed on the base seat by the pivot component; and the pivot component includes a hollow pipe arranged at the intake end of the nozzle assembly, the hollow pipe and the nozzle assembly are fixed together, and a sealing member is arranged between the hollow pipe and an air outlet of a casing within the base seat, so that the nozzle assembly and the hollow pipe rotate together.

* * * * *

UNITED STATES PATENT AND TRADEMARK OFFICE

CERTIFICATE OF CORRECTION

PATENT NO. : 8,721,307 B2
APPLICATION NO. : 13/686480
DATED : May 13, 2014
INVENTOR(S) : Dezheng Li It is certified that error appears in the above-identified patent and that said Letters Patent is hereby corrected as shown below:

On the Title Page, please add the following section which was omitted from the patent:

(30) Foreign Application Priority Data

| | | |
|---|---|---|
| May 27, 2010 | (CN) | .....201020205107.7 |
| June 12, 2010 | (CN) | .....201020224739.8 |
| September 7, 2010 | (CN) | .....201020519265.X |
| September 20, 2010 | (CN) | .....201020536812.5 |

Signed and Sealed this
Seventh Day of October, 2014

Michelle K. Lee

Michelle K. Lee
*Deputy Director of the United States Patent and Trademark Office*